US005781831A

United States Patent [19]

Matsuzaki et al.

[11] Patent Number: 5,781,831

[45] Date of Patent: Jul. 14, 1998

[54] DEVELOPING APPARATUS, PROCESS CARTRIDGE, IMAGE FORMING APPARATUS AND ASSEMBLY METHOD FOR PROCESS CARTRIDGES

[75] Inventors: Hiroomi Matsuzaki, Kawasaki; Toshiyuki Karakama, Tokyo; Kazunori Kobayashi, Kawasaki, all of Japan

[73] Assignee: Canon Kabushiki Kaisha, Japan

[21] Appl. No.: 783,795

[22] Filed: Jan. 15, 1997

Related U.S. Application Data

[63] Continuation of Ser. No. 683,917, Jul. 19, 1996, abandoned, which is a continuation of Ser. No. 345,459, Nov. 21, 1994, abandoned.

[30] Foreign Application Priority Data

Oct. 24, 1994 [JP] Japan ..... 6-258169
Nov. 26, 1994 [JP] Japan ..... 5-296410

[51] Int. Cl.[6] ..... G03G 15/04

[52] U.S. Cl. ..... 399/119; 399/111; 399/262

[58] Field of Search ..... 399/107, 109, 399/110, 111, 113, 119, 120, 258, 262; 355/200, 210, 245, 260; 358/296, 300

[56] References Cited

U.S. PATENT DOCUMENTS

| | | | |
|---|---|---|---|
| 4,639,119 | 1/1987 | Isaka | 355/260 X |
| 4,931,838 | 6/1990 | Ban et al. | 355/260 |
| 4,974,023 | 11/1990 | Aimoto et al. | 355/245 |
| 5,034,776 | 7/1991 | Sugiura | 355/260 |
| 5,153,649 | 10/1992 | Park | 355/260 |
| 5,223,068 | 6/1993 | Baley | 156/250 |
| 5,289,243 | 2/1994 | Sakamoto | 355/260 |
| 5,294,960 | 3/1994 | Nomura et al. | 355/210 |
| 5,369,475 | 11/1994 | Kashiwagi | 355/245 |
| 5,419,468 | 5/1995 | Taki | 355/260 X |

*Primary Examiner*—Sandra L. Brase

*Attorney, Agent, or Firm*—Fitzpatrick, Cella, Harper & Scinto

[57] ABSTRACT

A developing apparatus is constituted of a toner frame for containing developer and a developing frame for holding developer carrier, and both frames include plural pairs of connecting faces, one of which is made separable from the other faces, located at their connecting portion for mutual connection. When the apparatus is to be reused, the toner and developing frames are readily separated by removing the connecting face pair even where the connecting face pair formed at the connecting portion of the toner frame and developing frame had been connected by welding or whatever. The toner frame and developing frame can be reconnected by welding again the remaining connecting faces at their connecting portions.

72 Claims, 7 Drawing Sheets

DEVELOPING APPARATUS, PROCESS CARTRIDGE, IMAGE FORMING APPARATUS AND ASSEMBLY METHOD FOR PROCESS CARTRIDGES

This application is a continuation of application Ser. No. 08/683,917 filed Jul. 19, 1996, which is a continuation of application Ser. No. 08/345,459 filed Nov. 21, 1994, both now abandoned.

BACKGROUND OF THE INVENTION

1. Field of the Invention

This invention relates to a developing apparatus for forming an image using an electrophotographic method, a process cartridge, and an image forming apparatus, and an assembly method for the process cartridges.

2. Description of Related Art

Electrophotographic image forming apparatuses, for example, such as printers or photocopiers, expose an image carrier uniformly charged by a charger to light according to image information to form a latent image thereon. The apparatuses make the latent image visible with developer using a developing unit. The apparatuses then transfer the developed image to a recording medium to record the image. With such apparatuses, specialized service men have conducted maintenance of the respective parts thereof.

A cartridge capable of supplying the developer, of replacing parts such as an image carrier which had reached the end of its life time, and of rendering its maintenance easier, hence, has been effectuated by integrating certain elements such as the image carrier, the charger, the developing unit, a cleaning unit, and the like into a unit body and by mounting such body or cartridge into an apparatus body. Such a cartridge has begun to be collect ed from the market after use and reused in a process in which the parts are disassembled, cleaned and used again.

SUMMARY OF THE INVENTION

In the process cartridge thus described, its developing means may be constituted by welding a toner frame having a container for containing developer and a developing frame supporting such parts as a developing roller. Such a process cartridge is very effective because it can prevent the developer from leaking since the toner frame is firmly connected to the developing frame. However, the toner frame and the developing frame are difficult to separate by applying force to separate them for purpose of reuse, and disassembling work for reuse may be difficult.

This invention solves such a problem arising out of the conventional apparatuses. Its object is to provide a developing apparatus capable of easily reusing a toner frame and a developing frame, a process cartridge, an image forming apparatus, and an assembly method of the process cartridge.

Representative constitution regarding the invention to accomplish the object above solves the problem above by forming, in a developing apparatus constituted by combining a toner frame containing developer and a developing frame supporting a developer carrier, a plurality of connecting faces at the respective connecting portions of the toner frame and developing frame for connecting with each other, where one connecting face is separable from the other connecting face.

According to the invention, both frames can be easily separated from one another by separating the connecting portions from both frames when reused, even though a pair of the connecting faces formed at the connecting portions of the toner frame and the developing frame are connected by a method such as welding. The toner frame and the developing frame can be reconnected by a method such as welding the remaining connecting faces again.

In particular, if the apparatus is constituted so that a groove is formed at a part of each connecting face corresponding to the border of each connecting face, each connecting face could be cut off easily. Connecting faces a of used in a present connection of the frames can be prevented from contacting each other either by forming the connecting portion of at least one of the toner frame and the developing frame into a stepwise shape by connecting a pair of the connecting faces of the respective mating connecting portions through an intermediate member, so that other connecting faces are prevented from mistakenly being connecting. Specially, where an ultrasonic welding method is used in which only contacted portions are welded, the constitution thus described can specify the connecting faces contributing to the connection of the frames.

BRIEF DESCRIPTION OF THE DRAWINGS

The above and other objects and features of the invention will be apparent to those skilled in the art from the following preferred embodiments thereof when considered in conjunction with the accompanied drawings, in which.

DETAILED DESCRIPTION OF THE PREFERRED EMBODIMENTS

As an embodiment according to the invention, an electrophotographic image forming apparatus capable of receiving a process cartridge incorporating a developing apparatus is specifically described with reference to the drawings.

First Embodiment

Figure 1:
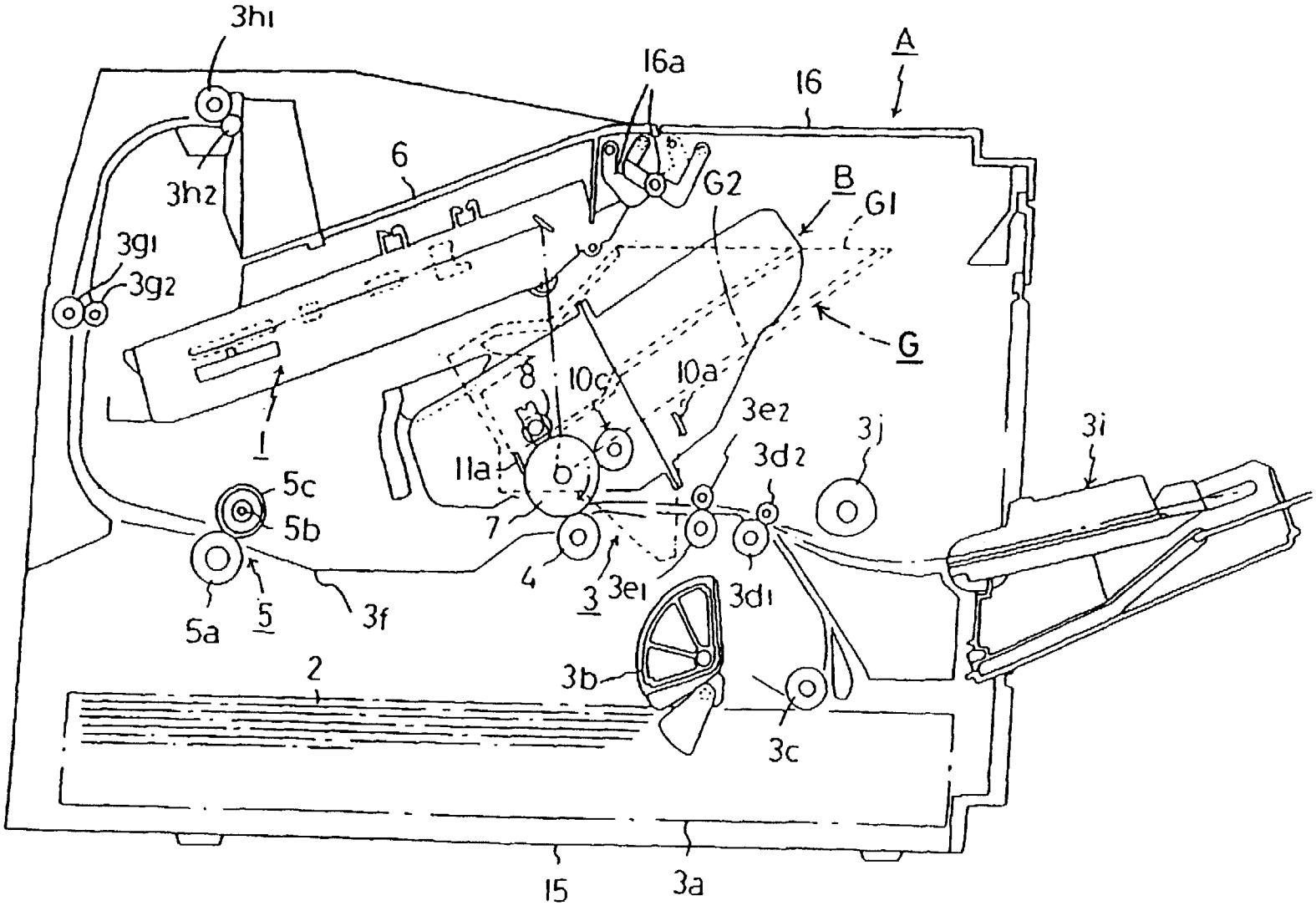
FIG. 1 is a diagram explaining the constitution of an image forming apparatus mounting a process cartridge having developing means according to a first embodiment of the invention.
Figure 2:
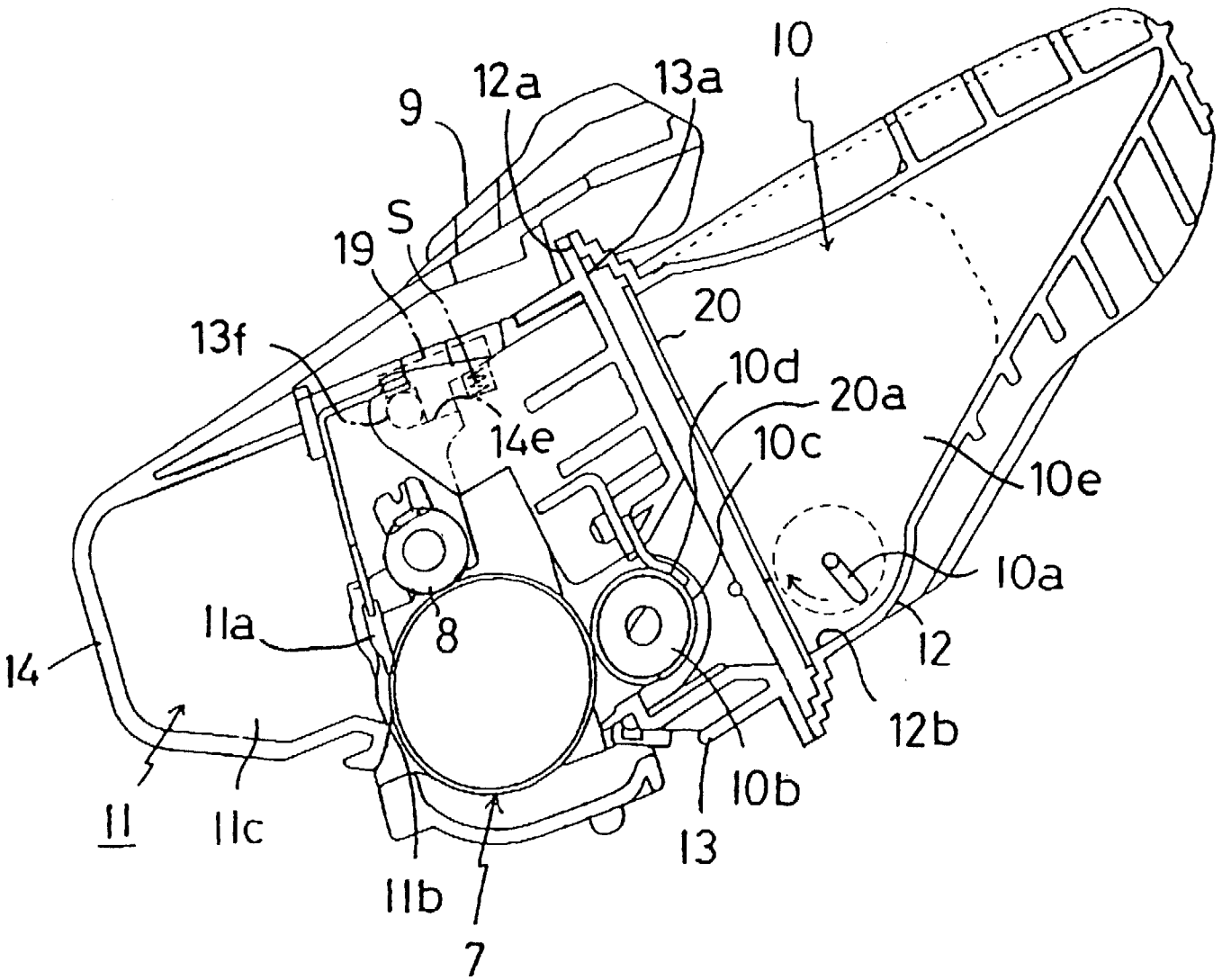
FIG. 2 is a diagram explaining the constitution of a process cartridge according to the first embodiment.

FIG. 1 is a diagram explaining the constitution of an image forming apparatus detachably mounting a process cartridge; FIG. 2 is a diagram explaining the constitution of a process cartridge. The overall constitution of the image forming apparatus attaching the process cartridge is described first, and then, the connecting constitution of the toner frame and the developing frame constituting the developing means becoming a developing apparatus is described.

The image forming apparatus A, as shown in FIG. 1, forms a latent image at a round surface of an electrophotographic photosensitive drum by emitting a photo image from an optical system 1 based on image information onto the photosensitive drum serving as an image carrier, and forms a toner image by clinging developer or toner thereto. In synchronism with formation of the toner image, a recording medium 2 is conveyed from a cassette 3*a* by conveying means 3 constituted of a pick-up roller 3*b*, a separating roller 3*c*, conveying roller pairs 3*d*1, 3*d*2, 3*e*1, 3*e*2, etc. At an image forming portion which is made into a cartridge as a process cartridge B, the toner image formed on the photosensitive drum is transferred onto the recording medium 2 by applying a voltage to a transfer roller 4 as transfer means. The recording medium 2 is conveyed to a fixing means 5 by a guide plate 3*f*. The fixing means 5 is composed of a driving roller 5*a* and a fixing roller 5*c* incorporating a heater 5*b* and fixes the transferred toner image by applying heat and pressure to the passing recording medium 2. The recording medium 2 is then conveyed by delivery roller pairs 3*g*1, 3*g*2, 3*h*1, 3*h*2 and is discharged to the delivery unit 6 through a reversing conveying route. In the case where the recording medium 2 is manually supplied, the medium is set in a manual feed tray 3*i* and conveyed by the pick-up roller 3*j* toward the conveying roller pair 3*d*1, 3*d*2.

Meanwhile, the process cartridge B forming an image forming unit, as shown in FIGS. 1, 2, rotates the photosensitive drum 7 having a photosensitive layer, uniformly charges its surface by application of a voltage to a charging roller 8 as charging means, forms a latent image by exposing a photo image out of the optical system 1 through an exposure opening 9 onto the photosensitive drum 7, and develops it using the developing means 10 as the developing apparatus. The developing means 10 sends out the toner in a toner reservoir 10*e* by using a toner supplier 10*a* , rotates a developing roller 10*c* incorporating a fixed magnet 10*b*, and forms a toner layer, in which electrical charges are given by fractional contact with a developing blade 10*d*, on the surface of the developing roller 10*c*. A toner image is then formed by transferring the toner onto the photosensitive drum 7 so as to correspond to the latent image, which is thereby made visible, and transferred to recording medium 2 by applying a voltage in opposition to the that of the toner image to the transfer roller 4. A cleaning blade 11*a*, after the toner image is transferred to the recording medium 2, scrapes off the remaining toner on the photosensitive drum 7, and a collecting sheet 11*b* collects it. Cleaning means 11, for collecting the toner in used toner vanes 11*c*, removes the remaining toner on the photosensitive drum 7.

The cartridge B of this embodiment thus forms a process cartridge including in a unit body the photosensitive drum 7, the charging roller 8, the developing means 10, and the cleaning means 11. That is, the process cartridge B has a constitution in which the developing means 10 and the like are attached to a developing frame 13, in which the cleaning means 11, the photosensitive drum 7, and the like are attached to a cleaning frame 14, and in which the developing frame 13 and the cleaning frame 14 are rotatably coupled around shafts 13*f* arranged at both sides in a widthwise direction of the developing frame 13. FIG. 2 shows only one side. That is, the cartridge is constituted so as to rotatably couple the developing frame 13 with the cleaning frame 14 where the shafts 13*f* are prevented from being put out by inserting the shafts 13*f* formed at the developing frame 13 into recesses 14*e* formed at the cleaning frame 14 and by fitting stoppers 19 respectively onto the recesses 14*e* of the cleaning frame 14.

A spring S pushes the developing frame 13 and the cleaning frame 14 toward respective directions of each other and makes the developing roller 10*c* and the photosensitive drum 7 close to each other. A ring member (not shown) having small thickness is attached to both sides in a longitudinal direction of the developing roller 10*c*. Contact of the ring member to the round face of the photosensitive drum 7 creates a small space between the developing roller 10*c* and the photosensitive drum 7.

The process cartridge B is detachably attached to cartridge attachment means G arranged at an apparatus body 15 as shown in FIG. 1. The cartridge attachment means G has the following constitution. That is, space for mounting the cartridge can be found within the apparatus body 15 when a lid 16 is opened around a shaft 16*a* as a center. Guide members G1 for guiding the process cartridge B when it is inserted are arranged at both inside sides of the space. A bracket G2 for supporting a designated portion of the process cartridge B is formed at a bottom of each guide member G1. The process cartridge B is mounted in the image forming apparatus A by inserting the process cartridge B along the guide members G1 and, in this manner the bracket G2 supports the bottom of a projected portion (not shown and formed at a part of the process cartridge B).

Toner Frame and Developing Frame Connection

Figure 3:
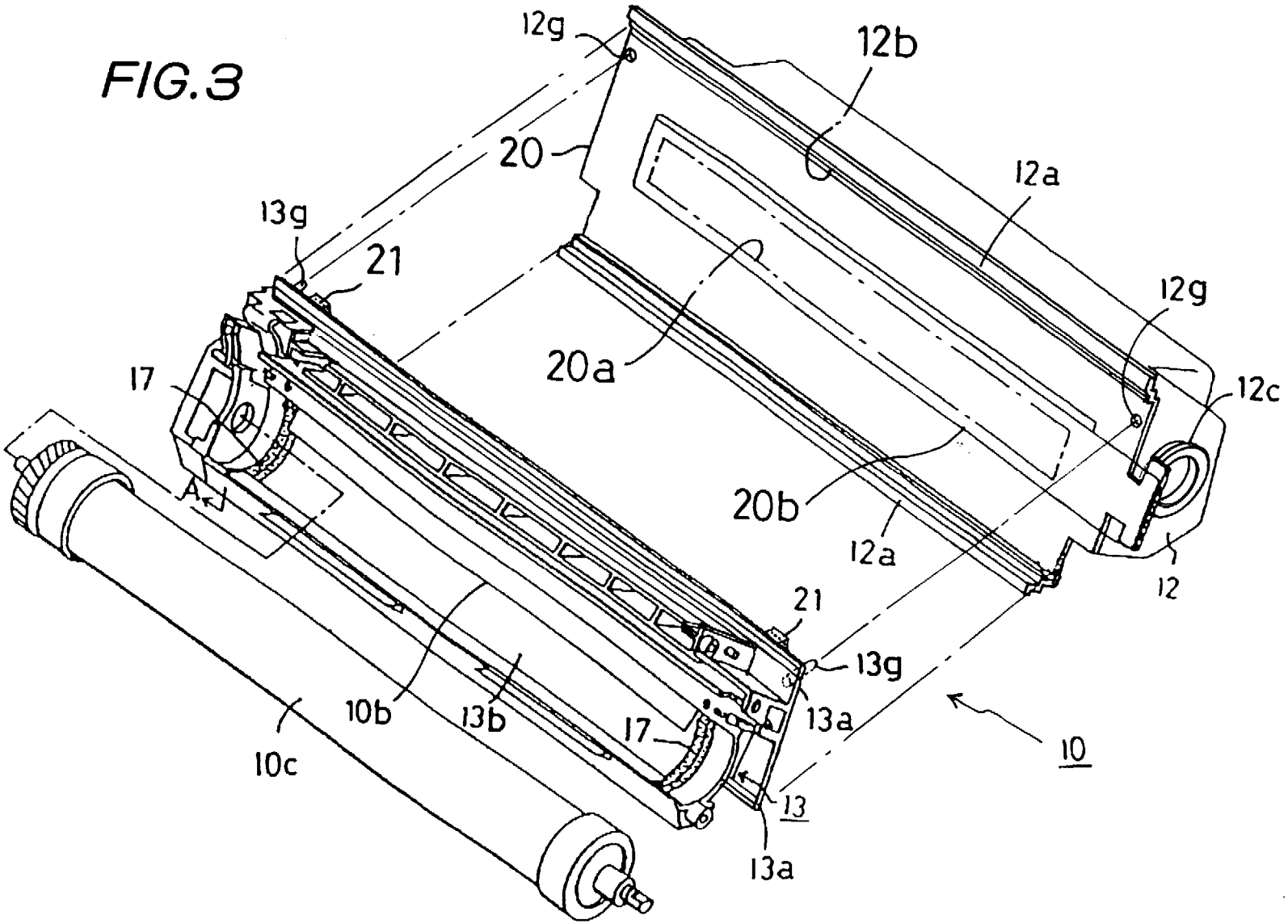
FIG. 3 is an exploded diagram explaining a toner frame and a developing frame according to a first embodiment.
Figure 4:
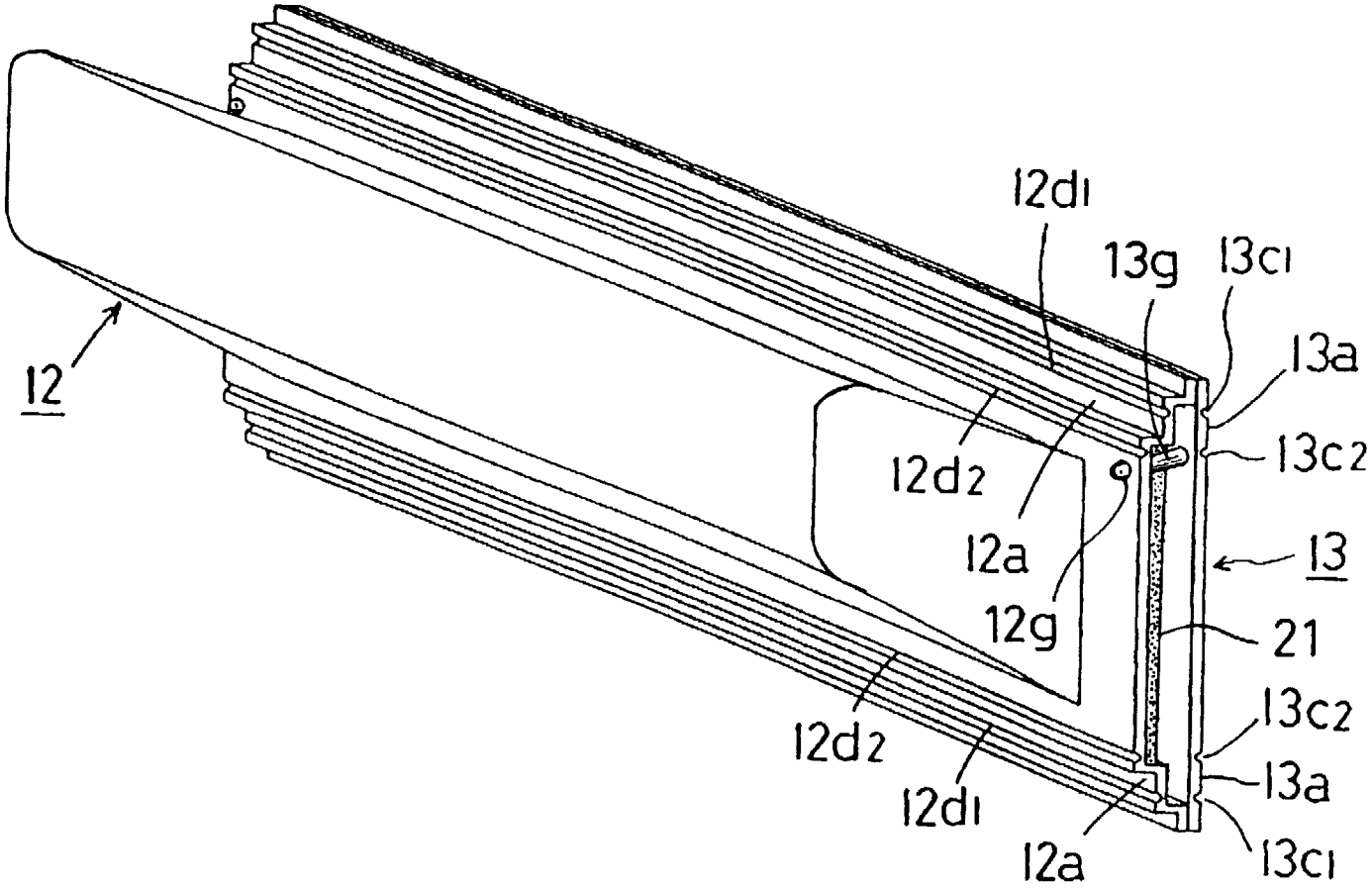
FIGS. 4 and 5 are diagrams explaining connecting faces of the toner frame and the developing frame according to the first embodiment.
Figure 5:
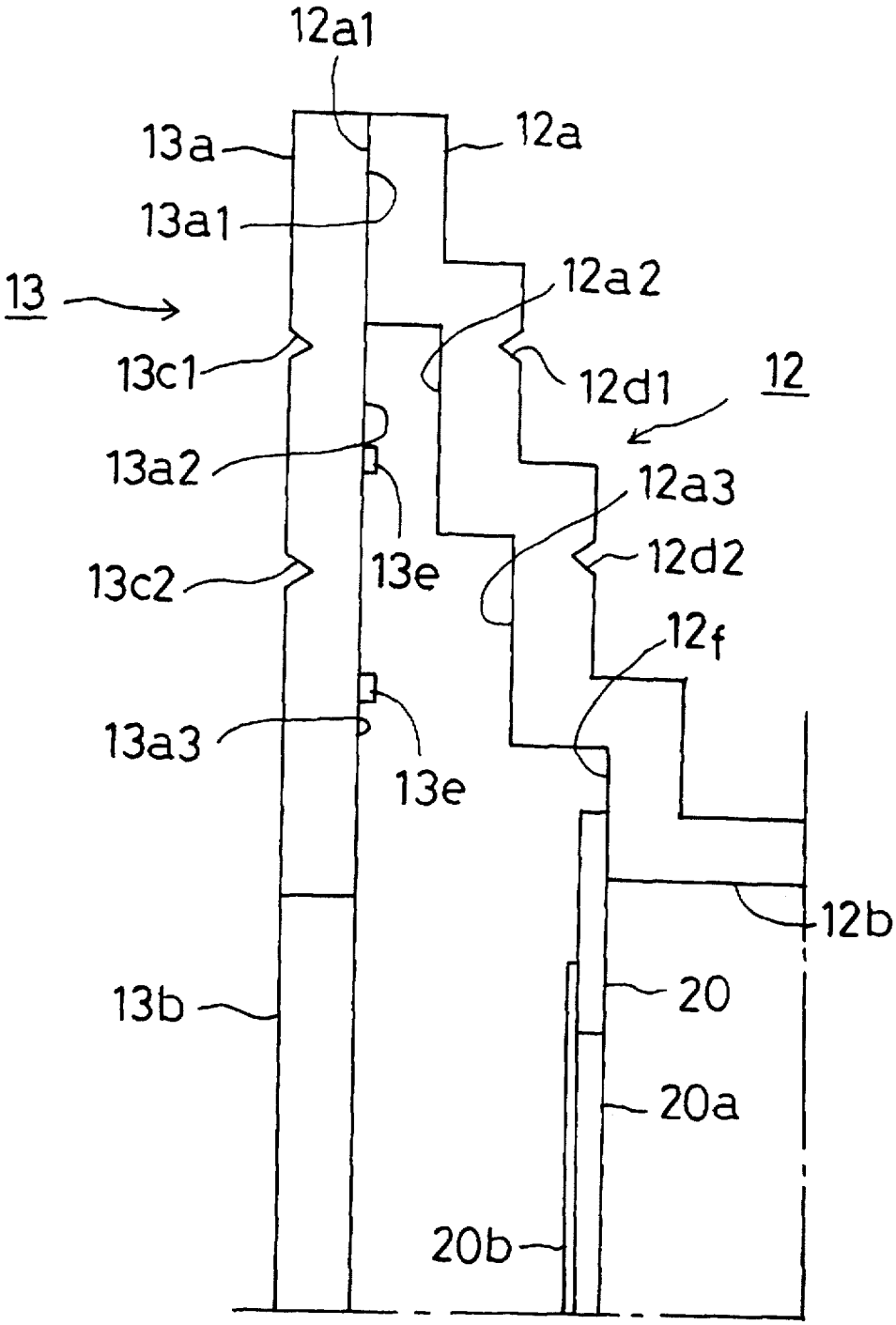
Figure 6:
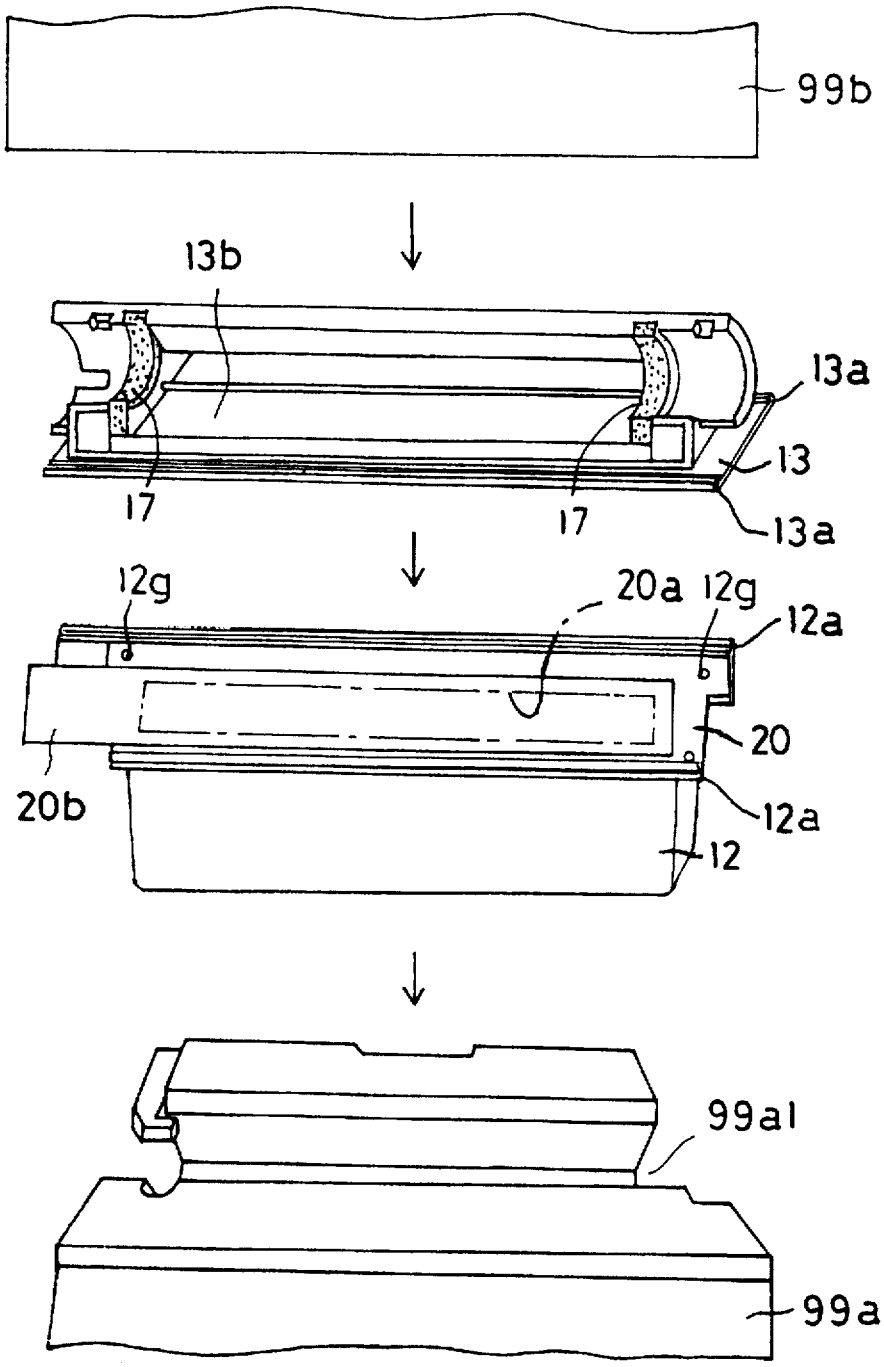
FIG. 6 is a diagram explaining a jig used for connecting work for the toner frame and the developing frame according to the first embodiment.

Referring to FIGS. 3 to 5, a connecting mechanism of a toner frame 12 for containing a toner and a developing frame 13 will be described as follows. FIG. 3 is an exploded diagram explaining the toner frame 12 and the developing frame 13; FIG. 4 is a perspective diagram showing a coupling situation of the toner frame 12 and the developing frame 13; FIG. 5 is a cross-sectional diagram of the connecting faces; FIG. 6 is an explanatory diagram of a jig used for connection work of the same.

The developing means 10, as shown in FIG. 3, is formed by connecting the toner frame 12 and the developing frame 13 with each other, both of which are formed of synthetic resin such as plastic resin. The toner frame 12 is a box for containing toner and is open at its one side; it is connected to the developing frame 13 such that its opening 12*b* faces the developing frame 13. As shown in FIG. 5, an opening limiting member 20 is a plate shape and is connected and attached to a stepwise face 12*a* formed at an opening 12*b*; the process cartridge is constituted so that toner is supplied from an opening 20*a* extending longitudinally through the opening limiting member 20 at the side of the developing frame 13. Where the cartridge is unused, a sealing tape 20*b* is attached to the opening limiting member 20 to seal the opening 20*a* so as to prevent toner contained therein from leaking out of the opening 20*a*. The sealing tape 20*b* allows toner in the toner frame 12 to be supplied from the opening 20*a* to the side of the developing frame 13 when an operator pulls it out at a time that the cartridge begins to be used.

The developing frame 13 is provided so that its developing roller 10*c* is rotatably attached to a face side in opposition to the side of connecting portion 13*a* to which the toner frame 12 is connected and so that a toner passing opening 13*b* is formed at a middle thereof. In this manner toner reaching the toner passing opening 13*b* clings to the surface of the developing roller 10*c*; the developing blade 10*b* forms a toner layer of a designated thickness on the round face of the developing roller 10*c*.

The toner frame 12 and the developing frame 13 are connected by ultrasonic welding of the connecting portions 12*a*, 13*a* arranged at upper and lower ends with respect to the respective openings 12*b*, 13*b* of the toner and developing frames 12, 13. That is, the toner frame 12 and the developing frame 13 are connected by the connecting faces 12*a*, 13*a* viewed in two lines extending widthwise thereof. Sponges 21 in a band shape are attached to both ends in the longitudinal direction of the developing frame 13. When the toner frame 12 and the developing frame 13 are connected, the sponges 21 contact both ends of the toner frame 12, and by its elasticity the developing frame 13 is tightly connected to the connecting portion 12*a* of the toner frame 12, thereby preventing toner from leaking out of side faces of the toner frame 12. The sponges 21 may as a matter of course be molded in a stepwise shape so as to fit to the connecting portion 12*a* of the toner frame 12.

A first connecting face 12*a*1, a second connecting face 12*a*2, and a third connecting face 12*a*3 are formed in a stepwise figure as shown in FIGS. 4 and 5 at the connecting face 12*a* of the toner frame 12. Long grooves 12*d*1, 12*d*2 are cut at opposite faces to the respective connecting faces 12*a*1, 12*a*2, 12*a*3 so as to correspond to the boundaries of the connecting faces 12*a*1, 12*a*2, 12*a*3. On the other hand, although a first connecting face 13*a*1, a second connecting face 13*a*2, and a third connecting face 13*a*3 are formed at the connecting portion 13*a* of the developing frame 13 so as to form respective pairs with the respective connecting faces of the toner frame 12, those connecting faces are formed in a straight line (planar), and grooves 13*c*1, 13*c*2 are formed at opposite faces to the respective connecting faces 13*a*1, 13*a*2, 13*a*3 so as to correspond similarly to the boundaries of the connecting faces 13*a*1, 13*a*2, 13*a*3. Linear projections 13*e* are formed on the respective connecting faces 13*a*1, 13*a*2, 13*a*3 of the developing frame 13, and when ultrasonic welding is performed the linear projections 13*e* melt and adhere to the connecting faces 12*a*1, 12*a*2, 12*a*3 of the toner frame 12. In FIG. 5, the toner frame 12 and the developing frame 13 are already welded at connecting faces 12*a*1 and 13*a*1, so that a linear projection 13*e* on the first connecting face 13*a* is not shown. A coupling hole 12*g* and a coupling boss 13*g* are formed at parts of the respective connecting portions 12*a*, 13*a* and used as guides for positioning the toner frame 12 and the developing frame 13 (see FIG. 4).

Now, assembly steps for such toner frame 12 and developing frame 13 are described. First, with a brand-new process cartridge B, an opening limiting member 20 to which a sealing tape 20*b* has been adhered is attached to the opening 12*b* of the toner frame 12, the toner container is filled with toner through a toner inlet 12*c* formed at a side-face of the toner frame 12, and the toner inlet 12*c* is sealed. The toner frame 12 and the developing frame 13 are then fixed using the coupling hole and boss 12*g*, 13*g* as guides so as to closely contact the respective first connecting faces 12*a*1, 13*a*1 thereof, and the first connecting faces 12*a*1, 13*a*1 are connected by ultrasonic welding.

The ultrasonic welding is performed with jigs shown in FIG. 6. The jigs are arranged to weld and fix the toner frame 12 and developing frame 13 between a receiving jig 99*a* and a pushing jig 99*b*. That is, the toner frame 12 is fitted into an indentation 99*a*1 of the receiving jig 99*a*, and the developing frame 13 is then mounted thereon where the sealing tape 20*b* attached to the opening limiting member 20 is in a folded condition. A clamp (not shown) temporarily fixes the connecting portions 12*a*, 13*a* of the toner frame 12 and developing frame 13. The toner frame 12 and developing frames 13 are made to adhere to each other using the pushing jig 99*b* over the developing frame 13. Only the linear projection 13*e* on the first connecting face 13*a*1, among the linear projections 13*e* formed on the connecting faces 13*a*1, 13*a*2, 13*a*3 of the developing frame 13, contacts the connecting portion 12*a* of the toner frame 12. The linear projection 13*e* melts when ultrasonic oscillation is applied, thereby making the first connecting face 13*a*1 of the developing frame 13 adhere to the first connecting face 12*a*1 of the toner frame 12. The ultrasonic oscillation does not affect the second and third connecting faces 12*a*2, 12*a*3, 13*a*2, 13*a*3 isolated from the first connecting faces since ultrasonic oscillation operation only on the contacted portion.

When the toner in such a brand-new process cartridge B has been consumed, the cartridge is collected and its toner frame 12 and developing frame 13 are to be reused. That is, remaining toner in the collected toner frame 12 and developing frame 13 is removed by blowing in air from an air spray or the like. The toner frame 12 and the developing frame 13 are then subject to cleaning and checking of their quality after separation before their reuse. The toner frame 12 and the developing frame 13 are disconnected and easily separated by cutting e.g., along the grooves 12*d*1, 13*c*1 whereby the first connecting faces 12*a*1, 13*a*1 are separated from the connecting portions 12*a*, 13*a*. The first connecting faces 12*a*1, 13*a*1 are cut by clamping those portions with a jig such as pliers and bending the faces along the grooves 12*d*1, 13*c*1 so as to divide the connecting portions. It is to be noted that operators may cut the connecting portions using a cutter or may cut them using a special jig having a cutting edge moving along the grooves 12*d*1, 13*c*1.

After that, the toner frame 12 and the developing frames 13 are cleaned; the opening limiting member 20, the sponges 21, the developing roller 10*c* (shown in FIG. 3), and the like are checked. Members needing to be replaced are replaced; the toner frame 12 is filled with toner again, and toner frame 12 and the developing frame 13 are then connected again. At such a second connection, the second connecting faces 12*a*2, 13*a*2 of the toner frame 12 and the developing frame 13 are connected by ultrasonic welding to each other.

It is to be noted that although a height of the process cartridge B may be made smaller more or less by removing the first connecting faces 12*a*1, 13*a*1, the process cartridge B is not affected and may be engaged to the image forming apparatus A by the engagement mechanism described above.

In the case that the process cartridge B once reused already is again to be reused, the second faces 12*a*2, 13*a*2 are separated at the grooves 12*d*2, 13*c*2 to divide the toner frame 12 and the developing frame 13, and upon cleaning and replacing their parts, the frames are connected by ultrasonic welding of their third connecting faces 12*a*3, 13*a*3.

As described above, the toner frame 12 and the developing frame 13 according to the present embodiment can be connected three times by ultrasonic welding, so that the frames 12, 13 are reused multiple times. In particular, the connecting portions 12*a*, 13*a* in the stepwise shape of the toner frame 12 and the developing frame 13 are easily separated at and by the grooves 12*d*1, 12*d*2, 13*c*1, 13*c*2, resulting in excellent work efficiency. The frames are reliably reused because both frames are separated without affecting the connecting faces 12*a*2, 12*a*3, 13*a*2, 13*a*3 to be used in following use. In addition, it is unnecessary to arrange the connecting portions 12*a*, 13*a* when reused, so that the working process can be simplified.

In this embodiment, only specified faces being contacted can be made to adhere at the time of ultrasonic welding because the connecting portion 12*a* of the toner frame 12 is formed in the stepwise shape, so that other unused connecting portions 12*a*, 13*a* are prevented from being connected inadvertently. Moreover, when the respective parts to be reused are checked for quality, the number of times the frames have been reused can be easily detected by viewing the number of cut portions, for example, the number of the grooves, of the connecting portions 12*a*, 13*a* in this embodiment, even though it is necessary to consider the number of times the respective parts have been used and to make those parts detectable of the number of times reused.

Although in this embodiment the connecting portions 12*a*, 13*a* are formed in first to third connecting faces, thereby enabling the connection three times, the number of connecting faces or grooves is changeable so as to meet with, such as, a limitation in the use of the toner frame 12 or developing frame 13. Although in this embodiment the connecting portion 12*a* of the toner frame 12 is made in the stepwise shape, the connecting portion 12*a* can be made to be flat while the connecting portion 13*a* of the developing frame 13 is made in a stepwise shape, as well as making both connecting portions 12*a*, 13*a* in a stepwise shape. Moreover, although in this embodiment grooves are located at the connecting portions 12*a*, 13*a*, the connecting portions 12*a*, 13*a* can be removed by using jigs along a line mark which is simply printed at the same position.

Second Embodiment

Figure 7:
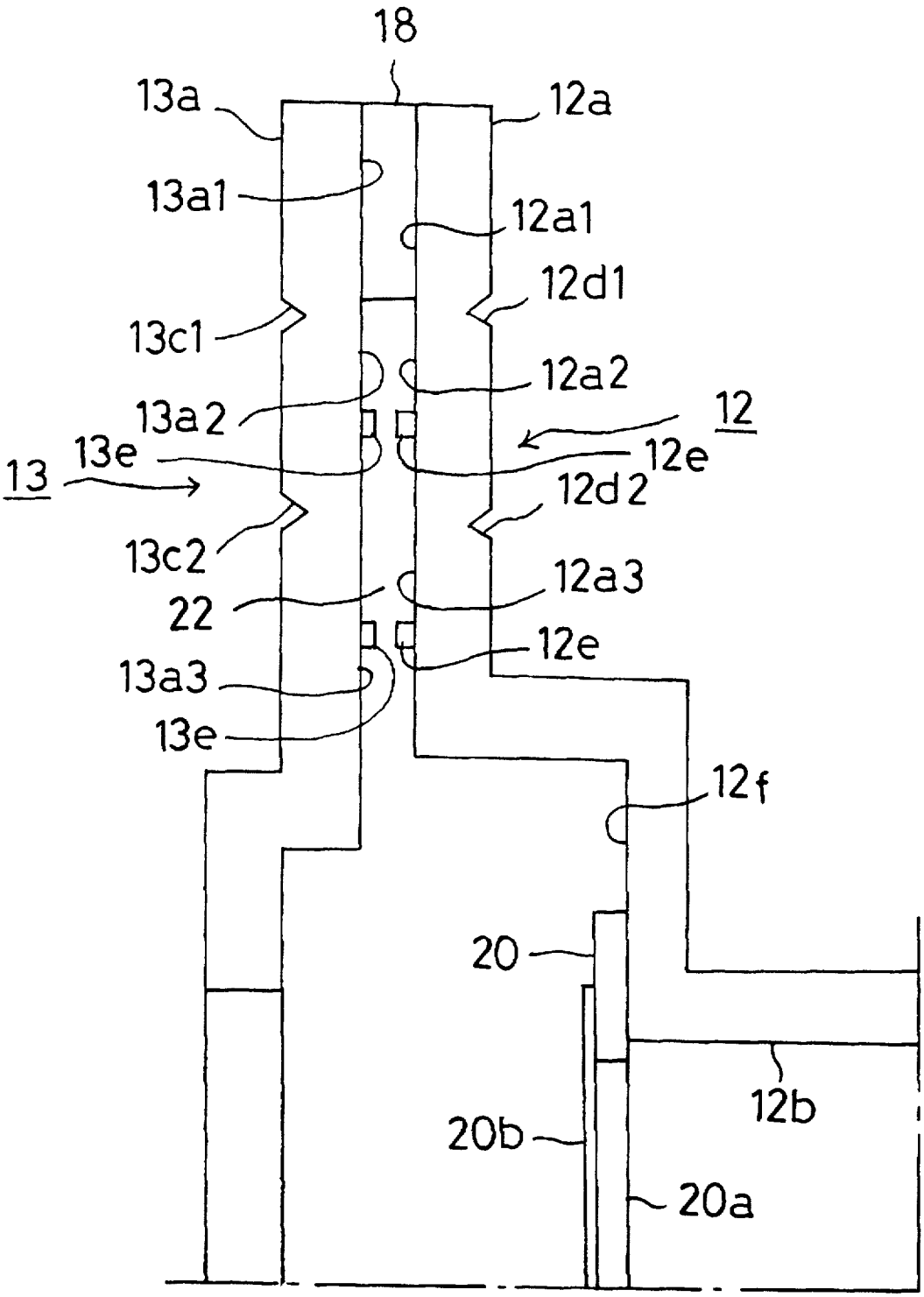
FIG. 7 is a diagram explaining the connecting faces of the toner frame and the developing frame according to a second embodiment.

Referring to FIG. 7, a second embodiment of a connecting mechanism of a toner frame 12 and a developing frame 13 will be described as follows. Portions having the same function to those of the first embodiment are given the same reference numbers, and their descriptions are omitted.

Although in the first embodiment described above the example is shown in which the first to third connecting faces 12*a*1 to 12*a*3 are formed in the stepwise shape at the connecting portion 12*a* of the toner frame 12 to couple the toner frame 12 with the developing frame 13, both faces can be formed in a flat shape.

As shown in FIG. 7, the developing frame 13 is formed with a first connecting face 13*a*1, a second connecting face 13*a*2, and a third connecting face 13*a*3 in a straight line, or flat shape, as in the first embodiment. On a side of the toner frame 12, similarly, first to third connecting faces 12*a*1 to 12*a*3 are formed in a flat shape. An intermediate member 18 in the form of a long plate shape is placed between the first connecting faces 12*a*1, 13*a*1, thereby connecting the toner frame 12 and the developing frame 13 under a condition that space 22 is formed between the second connecting faces 12*a*2, 13*a*2 and between the third connecting faces 12*a*3, 13*a*3.

When the toner frame 12 and the developing frame 13 are connected to form a brand-new process cartridge B, ultrasonic welding is performed upon the intermediate member 18 between the first connecting faces 12*a*1, 13*a*1. Because ultrasonic welding is effective only for faces contacting each other, only the first connecting faces 12*a*1, 13*a*1 are connected by the intermediate member 18 while the second connecting faces 12*a*2, 13*a*2 and the third connecting faces 12*a*3, 13*a*3, at which the space 22 is formed, are not affected at all. According to this embodiment, linear projections 12*e* for welding are formed on the connecting faces 12*a*1, 12*a*2, 12*a*3 of the toner frame 12 because both sides of the intermediate member 18 serve as faces for welding.

When the process cartridge B is collected to be reused, the toner frame 12 and the developing frame 13 are easily separated by cutting off the first connecting faces 12*a*1, 13*a*1 at the grooves 12*d*1, 13*c*1. When they are connected again, ultrasonic welding is performed with a new intermediate member 18 provided between the second connecting faces 12*a*2, 13*a*2. Further reuse is possible by using a third intermediate member 18 and connecting faces 12*a*3, 13*a*3.

According to this embodiment, the toner frame 12 and the developing frame 13 are connected using an intermediate member 18 by specifying designated connecting faces 12*a*1, 12*a*2, 12*a*3, 13*a*1, 13*a*2, 13*a*3 without forming any of connecting portions 12*a*, 13*a* in a stepwise shape. The intermediate member 18 is preferably made of readily weldable material compatiable with the toner frame 12 and the developing frame 13, such as of the same material as the toner frame 12 and the developing frame 13. The linear projections for welding could be formed not on the connecting portions of the toner and developing frames 12, 13 but on both sides of the intermediate member 18.

Other Embodiment

Although the embodiments described above show examples in which the toner frame 12 and the developing frame 13 are connected by ultrasonic welding, such connection can be done by other methods, such as hot melting, adhesive, or the like. The intermediate member in the second embodiment might be unnecessary if such adhesive can be made specific to the connecting faces.

The process cartridge B can apply not only for forming monochrome images but also preferably for forming multiple color images such as bicolor images, tricolor images, or full color images, by providing plural sets of developing means. As a developing method, various developing methods, such as a known two components magnetic blush developing method, cascade developing method, touchdown developing method, cloud developing method, or the like, can be used.

The following materials, not restricted to the photosensitive drum, are used as image carrier. A photoconductor can be used as the photosensitive body, and amorphous silicon, amorphous selenium, zinc oxide, titanium oxide, an organic photoconductor (OPC), or the like can be used as a photoconductor. A shape for mounting the photosensitive body can be a rotary body such as in a drum or belt shape, a sheet shape, or the like. A drum or belt shaped photosensitive body is generally used, in which, for example, a drum type photosensitive body is formed by evaporating or coating photoconductor on an aluminum alloy cylinder or the like.

Although a so called contact charging method is used as charging means in the first embodiment, the surface of a drum may be uniformly charged by providing metal shielding of such as aluminum on three quarters of a tungsten wire and then moving the surface of the photosensitive drum relative thereto to generate positive or negative charges thereon by application of a high voltage to the tungsten wire. As charging means, a blade type (charging blade), pad type, block type, rod type, wire type or the like is possible in lieu of the roller type as described above. As a method of cleaning off remaining toner on the photosensitive drum, a blade, a fur blush, a magnetic blush, or the like can constitute cleaning means.

The process cartridge as described above is formed with an electrophotographic photosensitive body as an image carrier and with developing means forming at least one of plural possible processing means. Alternatively, the process cartridge, for example, may include one an image carrier, developing means, charging means and cleaning means so as to form a united body detachably attached to the apparatus body, may include an image carrier, developing means, and charging means so as to form a united body detachably attached to the apparatus body, or may include an image carrier, developing means, and cleaning means so as to form a united body detachably attached to the apparatus body. That is, the process cartridge described above is defined as a cartridge integrally including charging means, cleaning means, developing means, and an electrophotographic photosensitive body detachably attached to the image forming apparatus body. The cartridge is also defined as a cartridge integrally including at least developing means and an electrophotographic photosensitive body detachably attached to the apparatus body.

Furthermore, although in the embodiments above a laser printer was exemplified as the image forming apparatus, this invention is not limited to such and can as a matter of course apply to other image forming apparatuses, for example a photocopier, a facsimile machine, or a word processing machine.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What we claim is:

1. A developer casing for an image forming apparatus in which an electrostatic latent image carried on an electrophotographic photosensitive member is developed with developer by developing means, said developer casing comprising:

a toner container for containing developer, said toner container including a connecting portion having a plurality of first connecting faces serially arranged and separable one-by-one; and a developing frame for detachably supporting developing means for developing a latent image carried on an electrophotographic photosensitive member, said developing frame including a connecting portion having a plurality of second connecting faces serially arranged and separable one-by-one, wherein said developing frame and said toner container are connectable to each other by coupling a single second connecting face selected from said plurality of second connecting faces on said developing frame and a single first connecting face selected from said plurality of first connecting faces on said toner container, and said single first and single second connecting faces used for connection are separable from the other of said first and second connecting faces.

2. A developer casing as set forth in claim 1, wherein the connecting portion of at least one of said toner container and said developing frame includes grooves formed therein at locations corresponding to respective boundaries between the connecting faces of said connecting portion.

3. A developer casing as set forth in claim 1, wherein a connecting face of the connecting portion of said toner container and a connecting face of the connecting portion of said developing frame are connected by hot melting, ultrasonic welding, or adhesive.

4. A developer casing as set forth in claim 1 or 2, wherein the plurality of connecting faces of at least one of said toner container and said developing frame are formed in a stepwise configuration.

5. A developer casing as set forth in claim 4, wherein a connecting face of the connecting portion of said toner container and a connecting face of the connecting portion of said developing frame are connected by ultrasonic welding.

6. A developer casing as set forth in claim 1 or 2, wherein one of said plurality of connecting faces of said toner container and one of said plurality of connecting faces of said developing frame are connected by an intermediate member provided therebetween.

7. A developer casing as set forth in claim 6, wherein said one connecting face of said toner container, the intermediate member, and said one connecting face of said developing frame are connected by ultrasonic welding.

8. A developer casing according to claim 1, wherein the plurality of connecting faces of each of said toner container and said developing frame are formed in a stepwise configuration.

9. A process cartridge detachably mountable to an image forming apparatus in which an electrostatic latent image carried on an electrophotographic photosensitive member is developed with developer by developing means, said process cartridge comprising:

an electrophotographic photosensitive member; and a developer casing comprising:

a toner container for containing developer, said toner container including a connecting portion having a plurality of first connecting faces serially arranged and separable one-by-one; and a developing frame for detachably supporting developing means for developing a latent image carried on said electrophotographic photosensitive member, said developing frame including a connecting portion having a plurality of second connecting faces serially arranged and separable one-by-one, wherein said developing frame and said toner container are connectable to each other by coupling a single second connecting face selected from said plurality of second connecting faces on said developing frame and a single first connecting face selected from said plurality of first connecting faces on said toner container, and said single first and single second connecting faces used for connection are separable from the other of said first and second connecting faces.

10. A process cartridge as set forth in claim 9, further comprising developer contained in said toner container.

11. A process cartridge as set forth in claim 9 or 10, wherein said process cartridge further comprises charging means or cleaning means supported by said developing frame for operating on said electrophotographic photosensitive member.

12. A process cartridge as set forth in claim 9 or 10, wherein said process cartridge includes charging means and cleaning means supported by said developing frame for operating on said electrophotographic photosensitive member.

13. A process cartridge according to claim 9, wherein the plurality of connecting faces of each of said toner container and said developing frame are formed in a stepwise configuration.

14. A process cartridge detachably mountable to an image forming apparatus in which an electrostatic latent image carried on an electrophotographic photosensitive member is developed with developer by developing means, said process cartridge comprising:

an electrophotographic photosensitive member; and a developer casing comprising a toner container for containing developer, and a developing frame for detachably supporting developing means for developing a latent image carried on said electrophotographic photosensitive member, said toner container including a connecting portion having a plurality of first connecting faces serially arranged and separable one-by-one, said developing frame including a connecting portion having a plurality of second connecting faces serially arranged and separable one-by-one, wherein the connecting portion of at least one of said toner container and said developing frame includes a groove formed therein at a location corresponding to a boundary between two of the plurality of connecting faces of said at least one connecting portion, and wherein said developing frame and said toner container are connectable to each other by coupling a single second connecting face selected from said plurality of second connecting faces on said developing frame and a single first connecting face selected from said plurality of first connecting faces on said toner container, and said single first and single second connecting faces used for connection are separable from the other of said first and second connecting faces.

15. A process cartridge according to claim 14, wherein the plurality of connecting faces of each of said toner container and said developing frame are formed in a stepwise configuration.

16. A process cartridge according to claim 14, wherein a connecting face of the connecting portion of said toner container and a connecting face of the connecting portion of said developing frame are connected by hot melting, ultrasonic welding, or adhesive.

17. A process cartridge according to claim 14, wherein the plurality of connecting faces of at least one of said toner container and said developing frame are formed in a stepwise configuration.

18. A process cartridge according to claim 17, wherein a connecting face of the connecting portion of said toner container and a connecting face of the connecting portion of said developing frame are connected by ultrasonic welding.

19. A process cartridge according to claim 14, wherein one of said plurality of connecting faces of said toner container and one of said plurality of connecting faces of said developing frame are connected by an intermediate member provided therebetween.

20. A process cartridge according to claim 14, wherein said one connecting face of said toner container, the intermediate member, and said one connecting face of said developing frame are connected by ultrasonic welding.

21. An image forming apparatus for forming images on recording media, said apparatus comprising:

an electrophotographic photosensitive member;

a process cartridge comprising a toner container, for containing developer, said toner container including a connecting portion having a plurality of first connecting faces serially arranged and separable one-by-one, and a developing frame for detachably supporting developing means for developing a latent image carried on said electrophotographic photosensitive member, said developing frame including a connecting portion having a plurality of second connecting faces, wherein the connecting portion of at least one of said toner container and said developing frame includes a groove formed in a location corresponding to a boundary between two of the plurality of connecting faces of said at least one connecting portion;

attaching means for detachably attaching said process cartridge; and conveying means for conveying recording media wherein said developing frame and said toner container are connectable to each other by coupling a single second connecting face selected from said plurality of second connecting faces on said developing frame and a single first connecting face selected from said plurality of first connecting faces on said toner container, and said single first and single second connecting faces used for connection are separable from the other of said first and second connecting faces not used for the connection.

22. An image forming apparatus as set forth in claim 21, wherein said image forming apparatus is a photocopier.

23. An image forming apparatus as set forth in claim 21, wherein said image forming apparatus is a laser printer.

24. An image forming apparatus asset forth in claim 21, wherein said image forming apparatus is a facsimile machine.

25. An image forming apparatus according to claim 21, wherein the plurality of connecting faces of each of said toner container and said developing frame are formed in a stepwise configuration.

26. An image forming apparatus according to claim 21, further comprising a photoimaging frame for supporting said electrophotographic photosensitive member.

27. An image forming apparatus according to claim 26, wherein said photoimaging frame further comprises a charging member for charging said electrophotographic photosensitive member.

28. An image forming apparatus according to either claim 26 or claim 27, wherein said photoimaging frame further comprises a cleaning member for removing residual toner from said electrophotographic photosensitive member.

29. An assembly method for a process cartridge comprising an image carrier, and process means, the process means including developing means comprising a developing frame and a toner frame, said process means being operable on the image carrier, said method comprising the steps of:

providing a connecting portion of the developing frame with plural first connecting faces serially arranged and separable one-by-one;

providing a connecting portion of the toner frame with plural second connecting faces serially arranged and separable one-by-one;

mounting the developing means excluding the toner frame onto the developing frame;

filling the toner frame with developer; and connecting a single first connecting face selected from the plural first connecting faces formed at the connecting portion of said developing frame with a single second connecting face selected from the plural second connecting faces formed at the connecting portion of said toner frame, wherein said single first and second connecting faces used for connection are separable from the other of said plural connecting faces.

30. An assembly method for a process cartridge according to claim 29, wherein said steps of providing connecting portions of the developing frame and toner frame with plural connecting faces includes providing the connecting portions of each of the developer frame and the toner frame in a stepwise configuration.

31. An assembly method according to claim 29, wherein said steps of providing a connecting portion of the developing frame and the toner frame with plural connecting faces, respectively, include forming grooves corresponding to respective boundaries between the connecting faces of at least one of the developing frame and the toner frame.

32. An assembly method according to claim 29, wherein said steps of providing a connecting portion of the developing frame and the toner frame with plural connecting faces, respectively, include forming grooves corresponding to respective boundaries between the connecting faces of each of the developing frame and the toner frame.

33. An assembly method according to claim 29, wherein said connecting step includes connecting a connecting face of the connecting portion of the developing frame with a connecting face of the correcting portion of the toner frame by hot melting, ultrasonic welding or adhesive.

34. An assembly method according to claim 29, wherein at least one of said steps of providing a connecting portion of the developing frame and the toner frame, respectively, includes forming the plural connecting faces in a stepwise configuration.

35. An assembly method according to claim 29, wherein said connecting step includes providing an intermediate member between a connecting face of the connecting portion of the developing frame and a connecting face of the connecting portion of the toner frame.

36. An assembly method according to claim 35, wherein said connecting step further includes ultrasonically welding the connecting face of the connecting portion of the developing frame, the intermediate member, and the connecting face of the connecting portion of the toner frame.

37. An assembly method according to claim 29, further comprising the step of providing a photoimaging frame for supporting an electrophotographic photosensitive member.

38. An assembly method according to claim 29, further comprising the steps of providing a photoimaging frame for supporting an electrophotographic photosensitive member and a charging member for charging the electrophotographic photosensitive member.

39. An assembly method according to claim 29, further comprising the step of providing a photoimaging frame for supporting an electrophotographic photosensitive member and a cleaning member for removing residual toner from the electrophotographic photosensitive member.

40. An assembly method according to claim 29, further comprising the step of providing a photoimaging frame for supporting an electrophotographic photosensitive member, a charging member for charging the electrophotographic photosensitive member, and a cleaning member for removing residual toner from the electrophotographic photosensitive member.

41. A developer casing for an image forming apparatus in which an electrostatic latent image carried on an electrophotographic photosensitive member is developed with developer by a developing device, said developer casing comprising:

a toner container for containing developer, said toner container including a connecting portion having a first plurality of connecting faces serially arranged and separable one-by-one; and a developing frame for detachably supporting a developing device for developing a latent image carried on an electrophotographic photosensitive member, said developing frame including a connecting portion having a plurality of second connecting faces serially arranged and separable one-by-one, wherein said developing frame and said toner container are connectable to each other by coupling a single second connecting face selected from said plurality of second connecting faces on said developing frame and a single first connecting face selected from said Plurality of first connecting faces on said toner container, and said first and second connecting faces used for connection are separable from the other of said first and second connecting faces.

42. A developer casing as set forth in claim 41, wherein the connecting portion of at least one of said toner container and said developing frame includes grooves formed therein at locations corresponding to respective boundaries between the connecting faces of said connecting portion.

43. A developer casing as set forth in claim 41, wherein a connecting face of the connecting portion of said toner container and a connecting face of the connecting portion of said developing frame are connected by hot melting, ultrasonic welding, or adhesive.

44. A developer casing as set forth in claim 41 or 42, wherein the plurality of connecting faces of at least one of said toner container and said developing frame are formed in a stepwise configuration.

45. A developer casing as set forth in claim 44, wherein a connecting face of the connecting portion of said toner container and a connecting face of the connecting portion of said developing frame are connected by ultrasonic welding.

46. A developer casing as set forth in claim 41 or 42, wherein one of said plurality of connecting faces of said toner container and one of said plurality of connecting faces of said developing frame are connected by an intermediate member provided therebetween.

47. A developer casing as set forth in claim 46, wherein said one connecting face of said toner container, the intermediate member, and said one connecting face of said developing frame are connected by ultrasonic welding.

48. A developer casing according to claim 41, wherein the plurality of connecting faces of each of said toner container and said developing frame are formed in a stepwise configuration.

49. A process cartridge detachably mountable to an image forming apparatus in which an electrostatic latent image carried on an electrophotographic photosensitive member is developed with developer by a developing device, said process cartridge comprising:

an electrophotographic photosensitive member; and a developer casing comprising:

a toner container for containing developer, said toner container including a connecting portion having a first plurality of connecting faces serially arranged and separable one-by-one; and a developing frame for detachably supporting a developing device for developing a latent image carried on said electrophotographic photosensitive member, said developing frame including a connecting portion having a plurality of second connecting faces serially arranged and separable one-by-one, wherein said developing frame and said toner container are connectable to each other by coupling a single second connecting face selected from said plurality of second connecting faces on said developing frame and a single first connecting face selected from said plurality of first connecting faces on said toner container, and said first and second connecting faces used for connection are separable from the other of said first and second connecting faces.

50. A process cartridge as set forth in claim 49, further comprising developer contained in said toner container.

51. A process cartridge as set forth in claim 49 or 50, wherein said process cartridge further comprises a charging device or a cleaning device supported by said developing frame for operating on said electrophotographic photosensitive member.

52. A process cartridge as set forth in claim 49 or 50, wherein said process cartridge includes a charging device and a cleaning device supported by said developing frame for operating on said electrophotographic photosensitive member.

53. A process cartridge according to claim 49, wherein the plurality of connecting faces of each of said toner container and said developing frame are formed in a stepwise configuration.

54. A process cartridge detachably mountable to an image forming apparatus in which an electrostatic latent image carried on an electrophotographic photosensitive member is developed with developer by a developing device, said process cartridge comprising:

an electrophotographic photosensitive member; and a developer casing comprising a toner container, for containing developer, and a developing frame for detachably supporting a developing device for developing a latent image carried on said electrophotographic photosensitive member, said toner container including a connecting portion having a plurality of first connecting faces serially arranged and separable one-by-one, said developing frame including a connecting portion having a plurality of second connecting faces serially arranged and separable one-by-one, wherein the connecting portion of at least one of said toner container and said developing frame includes a groove formed therein at a location corresponding to a boundary between two of the plurality of connecting faces of said at least one connecting portion, wherein said developing frame and said toner container are connectable to each other by coupling a single second connecting face selected from said plurality of second connecting faces on said developing frame and a single first connecting face selected from said plurality of first connecting faces on said toner container, and said first and second connecting faces used for connection are separable from the other of said first and second connecting faces.

55. A process cartridge according to claim 54, wherein the plurality of connecting faces of each of said toner container and said developing frame are formed in a stepwise configuration.

56. An image forming apparatus for forming images on recording media, said apparatus comprising:

an electrophotographic photosensitive member;

a process cartridge comprising a toner container for containing developer, said toner container including a connecting portion having a plurality of first connecting faces serially arranged and separable one-by-one, and a developing frame for detachably supporting developing means for developing a latent image carried on said electrophotographic photosensitive member, said developing frame including a connecting portion having a plurality of second connecting faces, wherein the connecting portion of at least one of said toner container and said developing frame includes a groove formed in a location corresponding to a boundary between two of the plurality of connecting faces of said at least one connecting portion, wherein said developing frame and said toner container are connectable to each other by coupling a single second connecting face selected from said plurality of second connecting faces on said developing frame and a single first connecting face selected from said plurality of first connecting faces on said toner container, and said first and second connecting faces used for connection are separable from the other of said first and second connecting faces;

a connector for detachably attaching said process cartridge; and a recording media conveyor for conveying recording media.

57. An image forming apparatus according to claim 56, wherein the plurality of connecting faces of each of said toner container and said developing frame are formed in a stepwise configuration.

58. An image forming apparatus according to claim 56, further comprising a photoimaging frame for supporting said electrophotographic photosensitive member.

59. An image forming apparatus according to claim 58, wherein said photoimaging frame further comprises a charging member for charging said electrophotographic photosensitive member.

60. An image forming apparatus according to either claim 58 or claim 59, wherein said photoimaging frame further comprises a cleaning member for removing residual toner from said electrophotographic photosensitive member.

61. An assembly method for a process cartridge comprising an image carrier and a processing device, the processing device including a developing device comprising a developing frame and a toner frame, said processing device being operable on the image carrier, said method comprising the steps of:

providing a connecting portion of the developing frame with plural first connecting faces serially arranged and separable one-by-one;

providing a connecting portion of the toner frame with plural second connecting faces serially arranged and separable one-by-one;

mounting the developing device excluding the toner frame onto the developing frame;

filling the toner frame with developer; and connecting a single first connecting face selected from the plural first connecting faces formed at the connecting portion of said developing frame with a single second connecting face selected from the plural second connecting faces formed at the connecting portion of said toner frame, wherein said single first and single second connecting faces used for connection are separable from the other of said plural connecting faces.

62. An assembly method for a process cartridge according to claim 61, wherein said steps of providing connecting portions of the developing frame and toner frame with plural connecting faces includes providing the connecting portions of each of the developing frame and the toner frame in a step-wise configuration.

63. An assembly method according to claim 61, further comprising the step of providing a photoimaging frame for supporting an electrophotographic photosensitive member.

64. An assembly method according to claim 61, further comprising the steps of providing a photoimaging frame for supporting an electrophotographic photosensitive member and a charging member for charging the electrophotographic photosensitive member.

65. An assembly method according to claim 61, further comprising the step of providing a photoimaging frame for supporting an electrophotographic photosensitive member and a cleaning member for removing residual toner from the electrophotographic photosensitive member.

66. An assembly method according to claim 61, further comprising the step of providing a photoimaging frame for supporting an electrophotographic photosensitive member, a charging member for charging the electrophotographic photosensitive member, and a cleaning member for removing residual toner from the electrophotographic photosensitive member.

67. An assembly method according to claim 61, wherein said steps of providing a connecting portion of the developing frame and the toner frame with plural connecting faces, respectively, include forming grooves corresponding to respective boundaries between the connecting faces of at least one of the developing frame and the toner frame.

68. An assembly method according to claim 61, wherein said steps of providing a connecting portion of the developing frame and the toner frame with plural connecting faces, respectively, include forming grooves corresponding to respective boundaries between the connecting faces of each of the developing frame and the toner frame.

69. An assembly method according to claim 61, wherein said connecting step includes connecting a connecting face of the connecting portion of the developing frame with a connecting face of the correcting portion of the toner frame by hot melting, ultrasonic welding or adhesive.

70. An assembly method according to claim 61, wherein at least one of said steps of providing a connecting portion of the developing frame and the toner frame, respectively, includes forming the plural connecting faces in a stepwise configuration.

71. An assembly method according to claim 61, wherein said connecting step includes providing an intermediate member between a connecting face of the connecting portion of the developing frame and a connecting face of the connecting portion of the toner frame.

72. An assembly method according to claim 71, wherein said connecting step further includes ultrasonically welding the connecting face of the connecting portion of the developing frame, the intermediate member, and the connecting face of the connecting portion of the toner frame.

* * * * *

UNITED STATES PATENT AND TRADEMARK OFFICE

CERTIFICATE OF CORRECTION

PATENT NO. : 5,781,831

DATED : July 14, 1998

INVENTORS : HIROOMI MATSUZAKI, ET AL.

It is certified that error appears in the above-identified patent and that said Letters Patent is hereby corrected as shown below:

COLUMN 1,
Line 35, "collect ed" should read --collected--.

COLUMN 2,
Line 9, "a of" should read --not--;
Line 13, "by" should read --or by--; and
Line 17, "ing." should read --ed.--.

COLUMN 3,
Line 37, "the" (first occurrence) should be deleted.

COLUMN 5,
Line 67, "operation" should read --operates--.

COLUMN 8,
Line 30, "coating" should read --coating a--;
Line 35, "of" (first occurrence) should be deleted; and
Line 49, "one" should be deleted.

UNITED STATES PATENT AND TRADEMARK OFFICE

CERTIFICATE OF CORRECTION

PATENT NO. : 5,781,831

DATED : July 14, 1998

INVENTORS : HIROOMI MATSUZAKI, ET AL.

It is certified that error appears in the above-identified patent and that said Letters Patent is hereby corrected as shown below:

COLUMN 13,
Line 47, "Plurality" should read --plurality--.

Signed and Sealed this

Fourth Day of May, 1999

*Attest:*

*Attesting Officer*

Q. TODD DICKINSON

*Acting Commissioner of Patents and Trademarks*